US007382885B1

(12) United States Patent
Kim et al.

(10) Patent No.: US 7,382,885 B1
(45) Date of Patent: Jun. 3, 2008

(54) MULTI-CHANNEL AUDIO REPRODUCTION APPARATUS AND METHOD FOR LOUDSPEAKER SOUND REPRODUCTION USING POSITION ADJUSTABLE VIRTUAL SOUND IMAGES

(75) Inventors: Sang-wook Kim, Seoul (KR); Doh-hyung Kim, Suwon (KR); Yang-seock Seo, Seoul (KR)

(73) Assignee: Samsung Electronics Co., Ltd., Suwon, Kyungki-Do (KR)

( * ) Notice: Subject to any disclaimer, the term of this patent is extended or adjusted under 35 U.S.C. 154(b) by 0 days.

(21) Appl. No.: 09/562,893

(22) Filed: May 1, 2000

(30) Foreign Application Priority Data

Jun. 10, 1999 (KR) ..... 1999-21555

(51) Int. Cl.
*H04R 5/00* (2006.01)
*H04R 5/02* (2006.01)

(52) U.S. Cl. ..... 381/17; 381/18; 381/19; 381/20; 381/23; 381/22; 381/21; 381/1; 381/310; 381/306

(58) Field of Classification Search ..... 381/17–23, 381/1, 310, 306
See application file for complete search history.

(56) References Cited

U.S. PATENT DOCUMENTS

| | | | | |
|---|---|---|---|---|
| 5,596,645 | A * | 1/1997 | Fujimori | 381/17 |
| 5,995,631 | A * | 11/1999 | Kamada et al. | 381/1 |
| 6,026,169 | A * | 2/2000 | Fujimori | 381/61 |
| 6,091,894 | A * | 7/2000 | Fujita et al. | 703/13 |
| 6,421,446 | B1 * | 7/2002 | Cashion et al. | 381/17 |
| 6,850,621 | B2 * | 2/2005 | Sotome et al. | 381/17 |

FOREIGN PATENT DOCUMENTS

| | | |
|---|---|---|
| EP | 0 889 671 A2 | 1/1999 |
| JP | 61-65299 | 6/1994 |
| JP | 08126098 | 5/1996 |
| KR | 98-031979 | 7/1998 |
| WO | 92/15180 | 9/1992 |

* cited by examiner

*Primary Examiner*—Vivian Chin
*Assistant Examiner*—Devona E Faulk
(74) *Attorney, Agent, or Firm*—Buchanan Ingersoll & Rooney PC

(57) ABSTRACT

A multi-channel audio reproduction apparatus and method for loudspeaker reproduction using virtual sound images whose positions can be adjusted is provided. The multi-channel audio reproduction apparatus includes a virtual sound image forming unit for compensating for the occurrence of cross-talk in at least one input audio signal according to the arrangement of loudspeakers, obtaining transfer functions occurring when sound from a position in a three dimensional space is transmitted to both ears of a listener, and forming a plurality of first virtual sound images in a three dimensional space using the transfer functions. A controller generates adjusting factors for adjusting the position of at least one second virtual sound image. An output position adjustor controls the at least one audio signal, with respect to which the plurality of first virtual sound images are formed by the virtual sound image forming unit, with the adjusting factors generated by the controller and adjusts positions of the at least one second virtual sound image. An adder sums up left output related signals of the at least one audio signal with respect to which the position of the at least one second virtual sound image is adjusted, and sums up right output related signals of the at least one audio signal with respect to which the position of the at least one second virtual sound image is adjusted, to generate left and right audio signals for forming the at least one second virtual sound image.

3 Claims, 12 Drawing Sheets

MULTI-CHANNEL AUDIO REPRODUCTION APPARATUS AND METHOD FOR LOUDSPEAKER SOUND REPRODUCTION USING POSITION ADJUSTABLE VIRTUAL SOUND IMAGES

The following is based on Korean Patent Application No. 99-21555 filed Jun. 10, 1999, herein incorporated by reference.

BACKGROUND OF THE INVENTION

1. Field of the Invention

The present invention relates to a three dimensional audio reproduction apparatus, and more particularly, to an audio reproduction apparatus and method for a loudspeaker using virtual sound images whose positions can be adjusted, the apparatus and method used in portable/personal multi-channel audio players, portable/personal digital audio broadcasting receivers, multimedia personal computers, HD television, audio/video home theatre systems and video conferencing.

2. Description of the Related Art

Conventionally, when an auditor intends to adjust the positions of loudspeakers or the space between the loudspeakers according to the auditor's taste, the auditor must directly move loudspeaker units to change their positions and angles. However, as technology develops, a process can be performed such that sound images are produced at the positions of virtual loudspeakers existing in a virtual space.

When changing the position of a virtual sound image using a conventional, three dimensional audio reproduction method, all the coefficients of a transfer function corresponding to the position must be provided so that a complexity problem in the size of a memory and a problem of reaction speed delay occurring when a coefficient changes, may occur.

To decrease the complexity problem in the size of a memory, coefficients at predetermined angles may be used. However, since the coefficients are obtained using a transfer function approximate expression, operation performance for solving the transfer function approximate expression is required, and a time delay occurs in obtaining the coefficients. In addition, since it is difficult to solve the expression with a simple controller, the assistance of a central processing unit is required.

With the advent of DVD, digital TV and HDTV broadcasting, multi-channel audio services are now being provided. To effectively enjoy the multi-channel audio, as many loudspeakers and amplifiers as the number of channels are necessary. Accordingly, a problem that a multi-channel audio effect cannot be achieved with existing two channel output systems occurs. To solve this problem, a method for providing a similar effect to a case of using many loudspeakers, is desired when reproducing multi-channel audio over two channels.

The method can be accomplished by providing many virtual sound images in a three dimensional space using two output ports. According to a conventional method for forming virtual sound images, when forming a single virtual sound image, a set of transfer functions corresponding to the left and right ears is used. When forming N virtual sound images, N transfer functions corresponding to the right ear and N transfer functions corresponding to the left ear are used. In other words, operation complexity increases in proportion to the number of virtual sound images to be formed, and the transfer functions for virtual sound images provided at predetermined positions must be stored in a memory so that a problem that the size of the memory must be increased can occur.

SUMMARY OF THE INVENTION

To solve the above problems, it is an object of the present invention to provide a multi-channel audio reproduction apparatus and method for loudspeaker sound reproduction using virtual sound images, wherein the positions of the virtual sound images can be changed without changing a filter coefficient.

Accordingly, to achieve the above object, the present invention provides a multi-channel audio reproduction apparatus for loudspeaker reproduction using virtual sound images whose positions can be adjusted. The apparatus includes a virtual sound image forming unit for compensating for the occurrence of cross-talk in at least one input audio signal according to the arrangement of loudspeakers, obtaining transfer functions occurring when sound from a position in a three dimensional space is transmitted to both ears of a listener, and forming a plurality of first virtual sound images in a three dimensional space using the transfer functions; a controller for generating adjusting factors for adjusting the position of at least one second virtual sound image; an output position adjustor for controlling the at least one audio signal, with respect to which the plurality of first virtual sound images are formed by the virtual sound image forming unit, with the adjusting factors generated by the controller and adjusting positions of the at least one second virtual sound image; and an adder for summing up left output related signals of the at least one audio signal with respect to which the position of the at least one second virtual sound image is adjusted, and for summing up right output related signals of the at least one audio signal with respect to which the position of the at least one second virtual sound image is adjusted, to generate left and right audio signals for forming the at least one second virtual sound image.

In another aspect, the present invention provides a multi-channel audio reproduction apparatus for loudspeaker reproduction using virtual sound images whose positions can be adjusted. The apparatus includes a controller for generating adjusting factors for adjusting the position of at least one second virtual sound image; an output position adjustor for controlling at least one input audio signal with the adjusting factors generated by the controller and adjusting the position of the at least one second virtual sound image; a virtual sound image forming unit for compensating for the occurrence of cross-talk in the at least one audio signal according to the arrangement of speakers, the audio signal having undergone the position adjustment for the second virtual sound image in the output position adjustor, obtaining transfer functions occurring when sound from a position in a three dimensional space is transmitted to both ears of a listener, and forming a plurality of first virtual sound images in a three dimensional space using the transfer functions; and an adder for summing up left output related signals of the at least one audio signal which has been processed by the output position adjustor and the virtual sound image forming unit, and for summing up right output related signals of the at least one audio signal which has been processed by the output position adjustor and the virtual sound image forming unit, to generate left and right audio signals for forming the at least one second virtual sound image.

In yet another aspect, the present invention provides a multi-channel audio reproduction apparatus for loudspeaker reproduction using a virtual sound image whose positions can be adjusted with respect to an input monaural audio signal. The multi-channel audio reproduction apparatus includes a controller for generating weighted values and values of phase delay for adjusting a position at which a second virtual sound image will be formed based on a predetermined position A at which a first virtual sound image will be formed and a predetermined position B at which a first virtual sound image will be formed, with respect to the input monaural audio signal; an output position adjustor for dividing the input monaural audio signal into two signals and applying the weighted value and the value of phase delay to each corresponding divided monaural audio signal to adjust the position at which the second virtual sound image will be formed; a virtual sound image forming unit comprising an A transfer function processor for multiplying a monaural audio signal, obtained by the application of the weighted value and the value of phase delay for the position A to one of the divided monaural audio signal, by transfer functions for forming the first virtual sound image at the predetermined position A, and a B transfer function processor for multiplying a monaural audio signal, obtained by the application of weighted value and the value of phase delay for the position B to the other divided monaural audio signal, by transfer functions for forming the first virtual sound image at the predetermined position B; and an adder for summing up signals corresponding to the right ear of a listener and summing up signals corresponding to the left ear of the listener, among the audio signals obtained by the multiplications of the transfer functions for forming the first virtual sound images at the predetermined positions A and B, to generate left and right signals for forming the second virtual sound image.

In still yet another aspect, the present invention provides a multi-channel audio reproduction apparatus for loudspeaker reproduction using virtual sound images whose positions can be adjusted with respect to input left and right stereo audio signals L and R. The multi-channel audio reproduction apparatus includes a controller for generating weighted values and values of phase delay for adjusting positions C-left and C-right at which second virtual sound images will be formed based on a predetermined position A at which a first virtual sound image will be formed and a predetermined position B at which a first virtual sound image will be formed, with respect to the input left and right stereo audio signals L and R; an output position adjustor for establishing an A position reference signal by adding a signal obtained by applying a weighted value and a phase delay value corresponding to the predetermined position A to the left signal L, to a signal obtained by applying a weighted value and a phase delay value corresponding to the predetermined position B to the right signal R, and for establishing a B position reference signal by adding a signal obtained by applying the weighted value and the phase delay value corresponding to the predetermined position A to the right signal R, to a signal obtained by applying the weighted value and the phase delay value corresponding to the predetermined position B to the left signal L, so as to adjust the positions at which the second virtual sound images will be formed; a virtual sound image forming unit comprising an A transfer function processor for multiplying the A position reference signal by transfer functions for forming the first virtual sound image at the predetermined position A, and a B transfer function processor for multiplying the B position reference signal by transfer functions for forming the first virtual sound image at the predetermined position B; and an adder for summing up signals corresponding to the right ear of a listener and summing up signals corresponding to the left ear of the listener, among the result signals of the multiplication of the transfer functions by the virtual sound image forming unit, to generate left and right signals for forming the second virtual sound images at the positions C-left and C-right.

In another aspect, the present invention provides a multi-channel audio reproduction apparatus for loudspeaker reproduction using virtual sound images whose positions can be adjusted with respect to five channel input audio signals, a left signal L, a right signal R, a back left signal SL, a back right signal SR, and a central signal C. The multi-channel audio reproduction apparatus includes a controller for generating weighted values and values of phase delay for adjusting positions C-left and C-right at which second virtual sound images will be formed based on a predetermined position A at which a first virtual sound image will be formed and a predetermined position B at which a first virtual sound image will be formed, with respect to the input five channel audio signals L, R, SL, SR and C; an output position adjustor for establishing an A position reference signal by adding a signal obtained by applying a weighted value and a phase delay value corresponding to the predetermined position A to the left signal L, a signal obtained by applying a weighted value and a phase delay value corresponding to the predetermined position B to the right signal R, the back left signal SL, and the central signal C, and for establishing a B position reference signal by adding a signal obtained by applying the weighted value and the phase delay value corresponding to the predetermined position A to the right signal R, a signal obtained by applying the weighted value and the phase delay value corresponding to the predetermined position B to the left signal L, the back right signal SR, and the central signal C, so as to adjust the positions at which the second virtual sound images will be formed; a virtual sound image forming unit comprising an A transfer function processor for multiplying the A position reference signal by transfer functions for forming the first virtual sound image at the predetermined position A, and a B transfer function processor for multiplying the B position reference signal by transfer functions for forming the first virtual sound image at the predetermined position B; and an adder for summing up signals corresponding to the right ear of a listener and summing up signals corresponding to the left ear of the listener, among the result signals of the multiplication of the transfer functions by the virtual sound image forming unit, to generate left and right signals for forming second virtual sound images at the positions C-left, C-right, center, back left and back right.

To achieve the above object, the present invention provides a multi-channel audio reproduction method for loudspeaker reproduction using virtual sound images whose positions can be adjusted. The method includes the steps of forming a plurality of first virtual sound images in an area in which a position can be adjusted in a three dimensional space with respect to input audio signals, and adjusting the position of a second virtual sound image by adjusting the significance of the plurality of first virtual sound images with respect to audio signals which have been processed for forming the plurality of first virtual sound images.

In another aspect, the present invention provides a multi-channel audio reproduction method for loudspeaker reproduction using virtual sound images whose positions can be adjusted with respect to an input monaural audio signal. The multi-channel audio reproduction method includes the steps of (a) generating signals for forming a first virtual sound image at a predetermined position A in a three dimensional space and signals for forming a first virtual sound image at a predetermined position B in the three dimensional space, with respect to the input audio signals, (b) applying weighted values and time delays to the signals for forming the first virtual sound images at the positions A and B, respectively, to adjust spatial positions of the first virtual sound images and the phase differences between the signals for forming the first virtual sound images, and (c) summing up signals corresponding to the right ear of a listener and summing up signals corresponding to the left ear of the listener, among the adjusted signals by the application of the weighted values and the time delays, to generate left and right signals for forming a second virtual sound image.

In yet another aspect, the present invention provides a multi-channel audio reproduction method for loudspeaker reproduction using virtual sound images whose positions can be adjusted with respect to an input monaural audio signal. The multi-channel audio reproduction method includes the steps of (a) applying weighted values and time delays corresponding to predetermined positions A and B to the input monaural audio signal to adjust a position at which a second virtual sound image will be formed, (b) multiplying an audio signal obtained by the application of the weighted value and the time delay for the position A to the input monaural audio signal, by transfer functions for forming the first virtual sound image at the predetermined position A, and multiplying an audio signal obtained by the application of the weighted value and the time delay for the position B to the input monaural audio signal, by transfer functions for forming the first virtual sound image at the predetermined position B, and (c) summing up signals corresponding to the right ear of a listener and summing up signals corresponding to the left ear of the listener, among the audio signals obtained by the multiplications of the transfer functions for forming the first virtual sound images at the predetermined positions A and B, to generate left and right signals for forming the second virtual sound image.

In still yet another aspect, the present invention provides a multi-channel audio reproduction method for loudspeaker reproduction using virtual sound images whose positions can be adjusted with respect to input left and right stereo audio signals L and R. The multi-channel audio reproduction method includes the steps of (a) with respect to the input left and right stereo audio signals L and R, establishing an A position reference signal by adding a signal obtained by applying a weighted value and a phase delay value corresponding to the predetermined position A to the left signal L, to a signal obtained by applying a weighted value and a phase delay value corresponding to the predetermined position B to the right signal R, and for establishing a B position reference signal by adding a signal obtained by applying the weighted value and the phase delay value corresponding to the predetermined position A to the right signal R, to a signal obtained by applying the weighted value and the phase delay value corresponding to the predetermined position B to the left signal L, so as to adjust positions C-left and C-right at which second virtual sound images will be formed, (b) multiplying the A position reference signal by transfer functions for forming a first virtual sound image at the predetermined position A, and multiplying the B position reference signal by transfer functions for forming a first virtual sound image at the predetermined position B, and (c) summing up signals corresponding to the right ear of a listener among the result signals obtained in the step (b) and summing up signals corresponding to the left ear of the listener among the result signals obtained in the step (b), to generate left and right signals for forming the second virtual sound images at the positions C-left and C-right.

In another aspect, the present invention provides a multi-channel audio reproduction method for loudspeaker reproduction using virtual sound images whose positions can be adjusted with respect to five channel input audio signals, a left signal L, a right signal R, a back left signal SL, a back right signal SR, and a central signal C. The multi-channel audio reproduction method includes the steps of (a) with respect to the input five channel audio signals L, R, SL, SR and C, establishing an A position reference signal by adding a signal obtained by applying a weighted value and a phase delay value corresponding to the predetermined position A to the left signal L, a signal obtained by applying a weighted value and a phase delay value corresponding to the predetermined position B to the right signal R, the back left signal SL, and the central signal C, and for establishing a B position reference signal by adding a signal obtained by applying the weighted value and the phase delay value corresponding to the predetermined position A to the right signal R, a signal obtained by applying the weighted value and the phase delay value corresponding to the predetermined position B to the left signal L, the back right signal SR, and the central signal C, so as to adjust positions C-left and C-right at which second virtual sound images will be formed, (b) multiplying the A position reference signal by transfer functions for forming a first virtual sound image at the predetermined position A, and multiplying the B position reference signal by transfer functions for forming a first virtual sound image at the predetermined position B, and (c) summing up signals corresponding to the right ear of a listener among the result signals obtained in the step (b) and summing up signals corresponding to the left ear of the listener among the result signals obtained in the step (b), to generate left and right signals for forming second virtual sound images at the positions C-left, C-right, center, back left and back right.

BRIEF DESCRIPTION OF THE DRAWINGS

The above objectives and advantages of the present invention will become more apparent by describing in detail a preferred embodiment thereof with reference to the attached drawings in which:

FIG. 1A for headphones, FIG. 1B for loudspeakers, and FIG. 1C for generalization of FIG. 1B;

DETAILED DESCRIPTION OF THE INVENTION

Figure 1A:
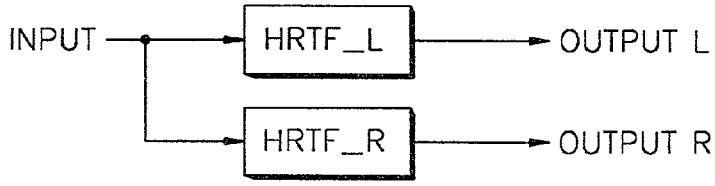
FIG. 1A (PRIOR ART)
FIGS. 1A through 1C show conventional methods for forming virtual sound images in a three dimensional space.

A method for forming a virtual sound image whose position can be adjusted using a head related transfer function, a cross-talk problem occurring during virtual sound image reproduction through a loudspeaker, and a method for solving the problem will be described. Then, a method for adjusting the position of a virtual sound image using two loudspeakers will be described.

A virtual sound image forming method uses a head related transfer function (HRTF). The HRTF is a transfer function in which a path from a sound source to a person's eardrum is mathematically modeled. The function characteristic of the HRTF varies according to the relative positional relation between the sound source and the head. More specifically, the HRTF, which is a transfer function in a frequency plan, for representing the propagation of sound from a sound source to the ear of a person in a free field, is a characteristic function reflecting frequency distortion occurring in the head, pinna and torso of a person.

The procedure through which a person hears sound will be simply reviewed. The ear of a person is largely divided into an external ear, a middle ear and an inner ear. The external ear usually called a pinna draws sound and is essential for perception of directions. The external auditory canal, which is about 0.7 cm in diameter and 2.5 cm in length, leads sound to an eardrum. Since the external auditory canal is roughly in the shape of a pipe with one end closed, it causes resonance at a particular frequency band. For this reason, there exists a frequency band to which the ear of a person is more sensitive.

Sound transmitted to the ear drum through the external auditory canal is transmitted to the middle ear. The sound vibrates the eardrum and thus is transmitted to the ossicle located immediately behind the eardrum. Since the ossicle has a function of amplifying a sound pressure, the sound is transmitted to a cochlea. The sound is perceived by the auditory nerves distributed on the basilar membrane on the inside of the cochlea.

In the aspect of ear structure, due to the irregular shape of the pinna, the frequency spectrum of a sound signal perceived by the auditory nerves is distorted before the sound enters into the external auditory canal. This distortion varies according to the direction or distance of sound. Accordingly, the change in frequency components is very important for a person to perceive the direction of sound. It is the HRTF that represents the extent of the frequency distortion.

The HRTF largely depends on the position of a sound source. With respect to a single sound source, the HRTF at the left ear of a listener can be different from the HRTF at the right ear of the listener. Moreover, since individuals have different shapes of pinnas and faces from one another, difference between the values of HRTFs for individuals can occur. Accordingly, the characteristics of HRTFs for many different individuals are measured and their average value is used as a modeled value.

HRTFs are measured by basically using the same method as that of measuring an impulse response of a system. In other words, the result of measuring an output of the system in response to an input impulse, is an impulse response. The result of converting the impulse response into the frequency domain is a HRTF.

A HRTF can be measured in many different ways. Usually, the value of a HRTF varies with the direction of a sound source and the position in an external auditory canal at which the measurement of the HRTF is performed. HRTFs have been measured at various positions in an external auditory canal during a test. It is known that to measure the HRTF at the beginning of an external auditory canal is very advantageous, so most tests are performed with this in mind. In 1960, Robinson and Whittle measured a HRTF at a position 6-9 mm outwardly away from the beginning of an external auditory canal. A HRTF was measured at the beginning of an external auditory canal by Wiener in 1947, Shaw in 1966, Burkhard and Sachs in 1975, Morimoto and Ando in 1980, and Lkabe and Miura in 1990. A HRTF was measured at a position 2 mm inwardly away from the beginning of an external auditory canal by Mehrgardt and Mellert in 1977. A HRTF was measured at a position 4 mm and a position 4-5 mm inwardly away from the beginning of an external auditory canal by Platt and Laws in 1978, Platte in 1979 and Genuit in 1984. A HRTF was measured at a position 5 mm inwardly away from the beginning of an external auditory canal by Blauert in 1974. In all the cases mentioned above, the HRTF was measured in a state in which an external auditory canal was not stopped. In some other cases, the HRTF has been measured with an external auditory canal stopped. In the inside of an external auditory canal, information on the direction of sound does not change but sound pressure varies with position.

For a dummy head used in a HRTF measuring test, usually, KEMAR is used. KEMAR is a mannequin made by Knowles Electronics. The measurement is carried out in an anachoic chamber in which reflective sound does not completely occur. KEMAR is mounted to a rotary body rotating in a 360-degree arc to the right and left. A plurality of loudspeakers are arranged in an arc to be movable up and down. An impulse response is measured using the values of signals which collect on a microphone from the voltage at the input terminal of a power amplifier.

A HRTF which is measured in such a manner indicates a frequency distortion which occurs when a signal is transmitted from one spatial point (for example, the position of a loudspeaker) to the ear of a person. When the distortion is applied to an audio signal, a listener feels as through the sound is from a spatial position other than the positions of the loudspeakers.

The method using the HRTF is referred to as a binaural method. The binaural system makes listeners feeling a three dimensional sound field feel as if they are at a recording site by reproducing sound, which is recorded at both ears of a dummy head imitating the head of a human, through a set of headphones or earphones.

Figure 2:
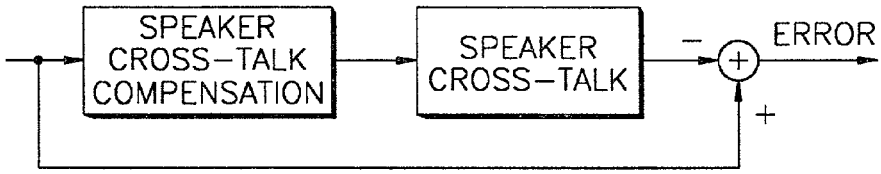
FIG. 2 (PRIOR ART)
FIG. 2 shows a method used for designing a filter for removing cross-talk which may occur during loudspeaker sound reproduction.

When reproducing sound, which is recorded using a dummy head model in a binaural system, through two loudspeakers, sound supposed to be heard by only the left ear is also heard by the right ear and sound supposed to be heard by only the right ear is also heard by the left ear, that is, cross-talk occurs. The cross-talk can be removed by performing inverted filtering on signals input to the loudspeakers to cancel cross-talk components, so that reproduction of a sound field can be more strictly realized. The method of performing inverted filtering for canceling cross-talk components is referred to as a transaural method. The transaural method is implemented prior to a loudspeaker for reproducing the signal which is inverse-filtered for compensating for the HRTF which is a transfer characteristic from a reproduction system to an ear drum. FIG. 2 shows cross-talk occurring when reproducing ideal three dimensional sound image reproduction signals, which are prepared by the binaural method, through loudspeakers, and a method for measuring a transfer function which is used for compensating for the cross-talk in the transaural method.

Cross-talk occurring during loudspeaker reproduction is represented by H11, H12, H21 and H22. H11 is a signal transmitted from a left loudspeaker to a left ear. H12 is a signal transmitted from the left loudspeaker to a right ear. H21 is a signal transmitted from a right loudspeaker to the left ear. H22 is a signal transmitted from the right loudspeaker to the right ear. A processor for compensating for the cross-talk is represented by "C". As a signal H is a 2×2 matrix, the processor C performs calculation with the structure of 2×2. Since the output of the left loudspeaker must be transmitted to only the left ear and the output of the right loudspeaker must be transmitted to only the right ear, for the result D of calculation, D11 and D22 are 1 and D12 and D21 are ideally 0.

Optimal solutions C11, C12, C21 and C22 are calculated such that the values of D11 and D22 approximate 1, the values of D12 and D21 approximate 2, and the sum of absolute values of D11, D12, D21 and D22 approximate 2, from:

$$\begin{bmatrix} C_{11} & C_{12} \\ C_{21} & C_{22} \end{bmatrix} \begin{bmatrix} H_{11} & H_{12} \\ H_{21} & H_{22} \end{bmatrix} = \begin{bmatrix} D_{11} & D_{12} \\ D_{21} & D_{22} \end{bmatrix}$$

If the values of C11, C12, C21 and C22 for processing cross-talk are calculated and used for sound before the sound is provided to a loudspeaker, a result approximating desired three dimensional sound can be obtained.

Figure 1B:
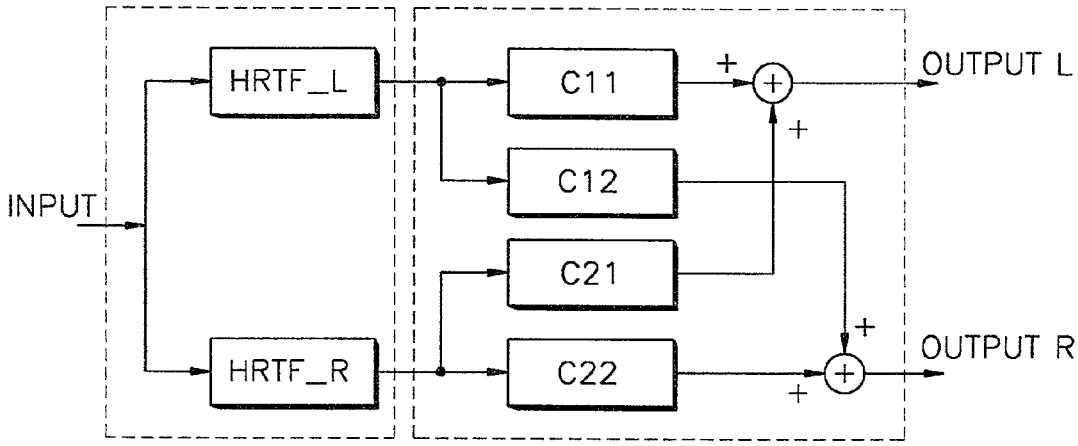
FIG. 1B (PRIOR ART)
Figure 1C:
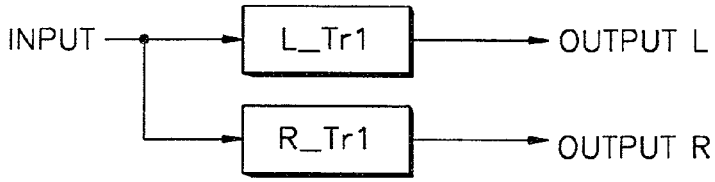
FIG. 1C (PRIOR ART)

FIGS. 1A through 1C show methods for forming three dimensional sound images using the binaural and transaural methods. FIG. 1A shows a method employing a binaural method using a left ear transfer function HRTF_L and a right ear transfer function HRTF_R. FIG. 1B shows a method for compensating for cross-talk occurring during loudspeaker reproduction using C11, C12, C21 and C22. FIG. 1C shows a conventional method in which the structure of FIG. 1B is simplified, wherein L_Tr1 is a value satisfying "C11*HRTF_L+C21*HRTF_R" and R_Tr1 is a value satisfying "C12*HRTF_L+C22*HRTF_R".

As video conferencing and game markets expand, three dimensional audio related to video objects is desired. In the field of the art, a sound image of three dimensional audio is not fixed to a predetermined position but continuously moves. In other words, the ability to adjust a sound image is required. In a case of using the HRTF as in conventional methods, when changing the position of a sound image which has been formed at a virtual position, the HRTF for operation must be changed into a HRTF corresponding to a target position. This is because a process is performed using a particular transfer function, which was previously obtained for forming a virtual sound image at a predetermined position in a three dimensional space, when changing the position of the virtual sound image in the three dimensional space. Accordingly, when changing the position of a virtual sound image, a transfer function corresponding to a target position is read from a transfer function database for processing. When there are many virtual sound images to be moved, the complexity of a memory for storing transfer functions increases, and a response is delayed from a time when change in a transfer function is requested for the movement of a virtual sound image to a time when a result obtained based on a changed transfer function is output.

These problems can be solved by a method according to the present invention in which, after first virtual sound images A and B are positioned at two spatial points, weighted values, which are applied to the first virtual sound images A and B according to their positions, respectively, are adjusted to form a movable virtual sound image between the first virtual sound images A and B. According to the method of the present invention, the position of a virtual sound image can be changed in a three dimensional space without changing the HRTF every time the position is changed.

Even if two virtual sound sources are formed in a space, they are heard as if they are one. A simple example of this case is as follows.

When transmitting a monaural signal to both right and left loudspeakers equally, that is, when reproducing sound in a dual mode, a sound image by the signal gives an illusion that the sound is from the center of the two loudspeakers. When the same sound is reproduced in an environment in which one loudspeaker is positioned in front of a listener and the other loudspeaker is positioned to the right of the listener and perpendicular to the front loudspeaker, the listener feels like the sound is from a position to one's right between the two loudspeakers. Taking into account this illusion, a third virtual sound image, which is moved between two virtual sound images of a monaural signal which are formed at predetermined spatial positions, can be formed by adjusting weighted values of signals working in forming the two virtual sound images, respectively, and the phase difference between the two signals.

Figure 3A:
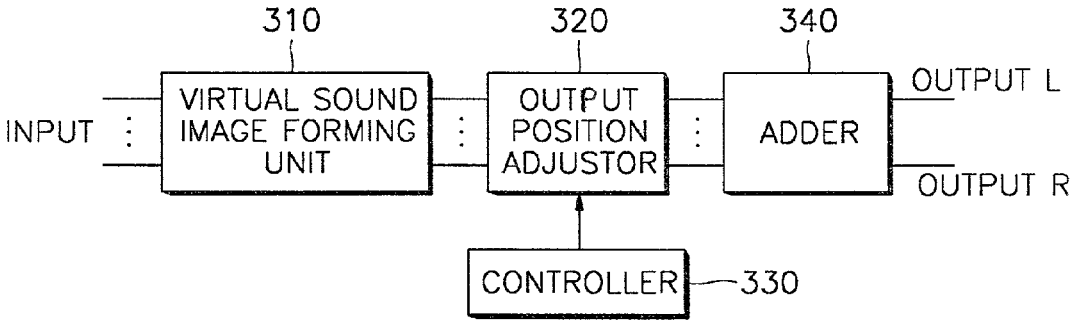
FIGS. 3A and 3B are block diagrams for showing embodiments of a method for forming virtual sound images, whose positions can be adjusted in a three dimensional space, through loudspeakers, according to the present invention.
Figure 3B:
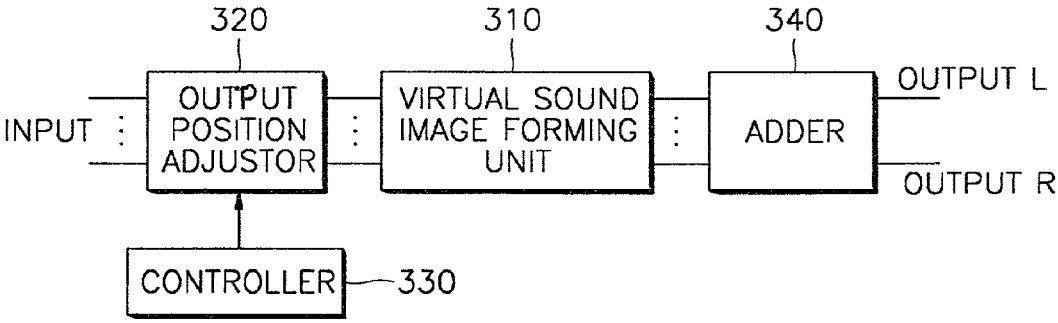

Referring to FIGS. 3A and 3B, an apparatus for forming a position adjustable virtual sound image according to the present invention, includes a virtual sound image forming unit 310, an output position adjustor 320, a controller 330 and an adder 340.

Referring to FIG. 3A, once input signals are received by the apparatus, the input signals are passed through the virtual sound image forming unit 310 and the output position adjustor 320, which is controlled by the controller 330, and transmitted to the adder 340. The adder 340 generates output signals L and R for loudspeakers.

The virtual sound image forming unit 310 forms first virtual sound images at a position A and a position B in a three dimensional space based on the input signals. The output position adjustor 320 forms a second virtual sound image at a position C by adjusting the phase difference between signals, which are related to the two first virtual sound images A and B, respectively, using weighted values and time delays which are received from the controller 330 and applied to the first virtual sound image related signals.

The apparatus for forming a position adjustable virtual sound image according to the present invention can be implemented such that input signals are passed through the virtual sound image forming unit 310 prior to passing through the output position adjustor 320 as shown in FIG. 3A or input signals are passed through the output position adjustor 320 prior to passing through the virtual sound image forming unit 310 as shown in FIG. 3B.

FIG. 3B shows a case in which input signals are passed through the output position adjustor 320 prior to passing through the virtual sound image forming unit 310. Once the input signals are input to the output position adjustor 320, the output position adjustor 320 multiplies the input signals by weighted values corresponding to first virtual sound images A and B, respectively, for formation of a second virtual sound image C. The weighted values are transmitted from the controller 330. Next, the output position adjustor 320 adjusts the phase difference between result signals of the multiplication. The virtual sound image forming unit 310 multiplies some of the output signals of the output position adjustor 320 by transfer functions for forming the first virtual sound image A, to obtain a signal related to the first virtual sound image A, and multiplies the other output signals of the output position adjustor 320 by transfer functions for forming the first virtual sound image B, to obtain a signal related to the first virtual sound image B. The adder 340 adds the obtained first virtual sound image A signal and first virtual sound image B signal which are received from the virtual sound image forming unit 310 to generate a second virtual sound image C signal which a listener hears in practice.

In other words, multi-channel audio input signals sequentially pass through the output position adjustor 320 controlled by the controller 330, the virtual sound image forming unit 310 for loudspeakers and the adder 340, and are generated as signals L and R to achieve the effect of multi-channel audio reproduction through two loudspeakers. More specifically, the output position adjustor 320 adjusts the sizes of the input multi-channel audio signals and the phase differences among the multi-channel audio signals to allow signals to be overlapped and outputs the result signals of the adjustment to the virtual sound image forming unit 310 for loudspeakers. The virtual sound image forming unit 310 for loudspeakers receives the adjusted signals and generates three dimensional signals. The three dimensional signals are output as signals L and R by the adder 340.

Figure 4A:
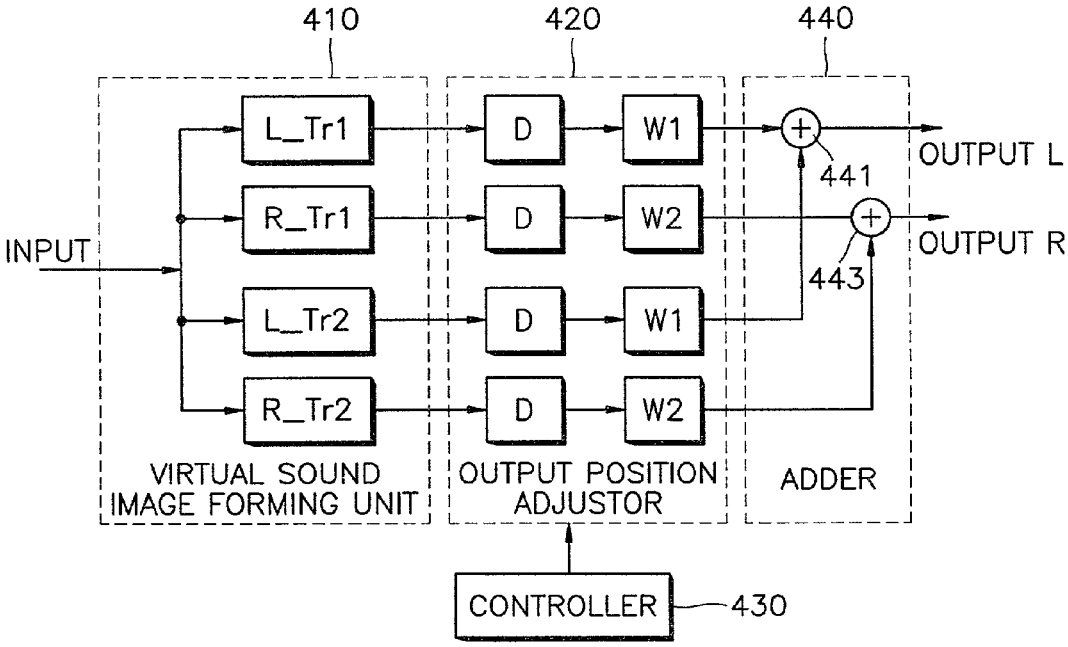
FIGS. 4A and 4B are block diagrams for showing the detailed embodiments of a method for forming a new single virtual sound image whose position can be adjusted by embodiments of the methods for forming virtual sound images, whose positions can be adjusted in a three dimensional space, through loudspeakers, according to the present invention.
Figure 4B:
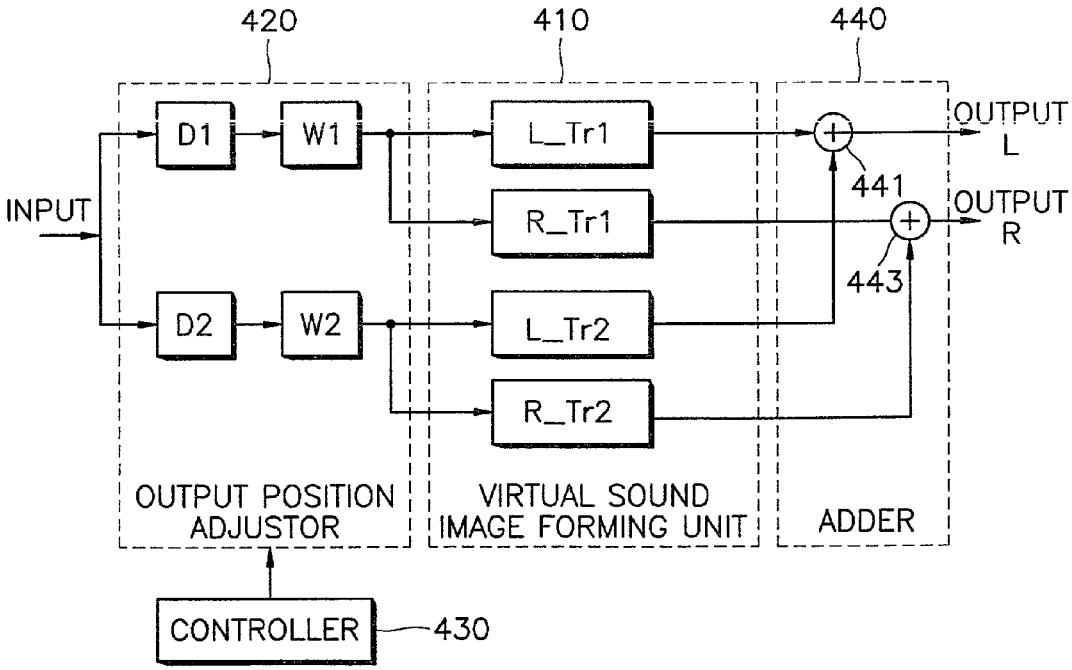

FIGS. 4A and 4B show the detailed embodiments of a method for forming a virtual sound image whose position can be adjusted in a three dimensional space through loudspeakers. Referring to FIGS. 4A and 4B, each apparatus for forming a new single position adjustable virtual sound image by applying a method of forming two virtual sound images, includes a virtual sound image forming unit 410, an output position adjustor 420, a controller 430 and an adder 440.

FIG. 4A shows the configuration of the apparatus of the present invention in detail when the virtual sound image forming unit 410 is disposed preceding the output position adjustor 420. FIG. 4B shows the configuration of the apparatus of the present invention in detail when the output position adjustor 420 is disposed preceding the virtual sound image forming unit 410.

Referring to FIG. 4B, once input monaural signals are received by the output position adjustor 420, the output position adjustor 420 performs an operation with respect to the received signals and, weighted values and values of phase delay, which are transmitted from the controller 430 and correspond to first virtual sound images A and B, respectively.

The virtual sound image forming unit 410 multiplies some of the outputs of the output position adjustor 420 by transfer functions for forming the first virtual sound image A to generate signals related to the first virtual sound image A, and multiplies the other outputs of the output position adjustor 420 by transfer functions for forming the first virtual sound image B to generate signals related to the first virtual sound image B.

The adder 440 sums up signals related to the left among the output signals of the virtual sound image forming unit 410 to generate an output L and sums up signals related to the right among the output signals of the virtual sound image forming unit 410 to generate an output R, for forming a second virtual sound image C.

For the monaural signal, in a case in which one of the first virtual sound images is to be positioned at the center between two loudspeakers, one of the operation on L_Tr1 and R_Tr1 and the operation on L_Tr2 and R_Tr2 can be performed with the assumption that a transfer function is 1. In this occasion, the number of operations can be reduced.

The input and output of each transfer function terminal of the virtual sound image forming unit 410 are supposed to have the same value. To compensate for phase differences occurring when forming a second virtual sound image, phase delay occurring when performing operations is eliminated by adjusting values D1 and D2. Weighted values W1 and W2 are adjusted by the controller 430, thereby allowing the position of a second virtual sound image which is formed in a virtual space according to a transfer function to be adjusted between the first virtual sound images A and B. The weighted values W1 and W2 which are used for forming a single second virtual sound image and also adjusting the position of the second virtual sound image are characterized in that W1+W2=1.

Figure 5A:
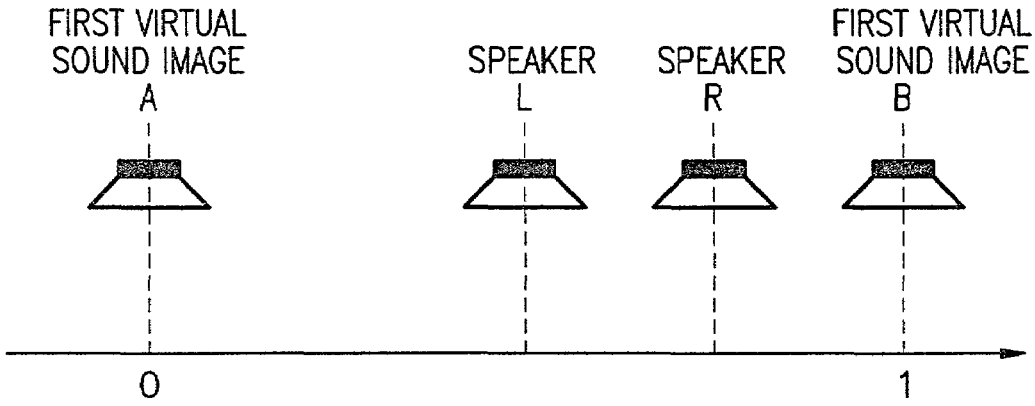
FIGS. 5A and 5B are embodiments each for forming a single virtual sound image, whose position can be adjusted, with two loudspeakers.
Figure 5B:
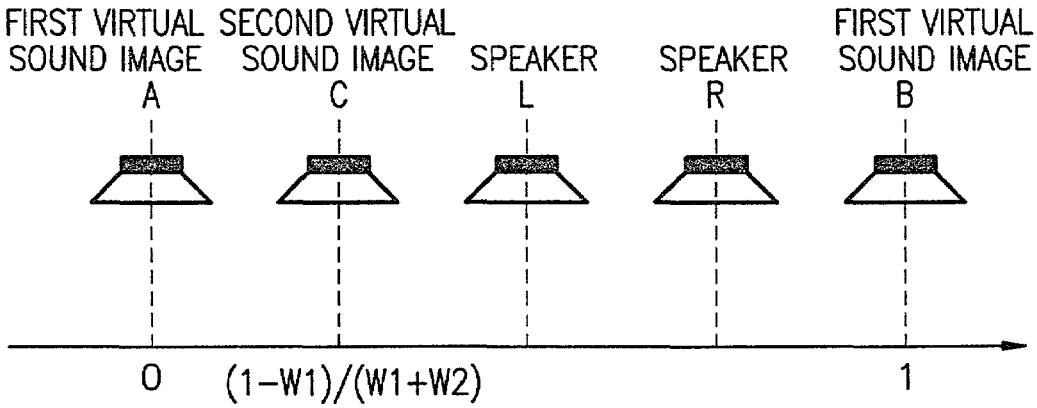

In a case in which the first virtual sound images A and B are formed as shown in FIG. 5A, when the weighted value W1 is applied to the virtual sound image A and the weighted value W2 is applied to the virtual sound image B, the second virtual sound image C is formed at a position a distance (1−W1)/(W1+W2) apart from the first virtual sound image A as shown in FIG. 5B. For example, if W1=0.5, W1=W2=0.5, so that the virtual sound image C is positioned at the center between the first virtual sound images A and B. If W1=0.25 and W2=0.75, the virtual sound image C is closer to the first virtual sound image B than to the first virtual sound image A. If W1=0.75 and W2=0.25, the virtual sound image C is closer to the first virtual sound image A than to the first virtual sound image B.

Figure 6A:
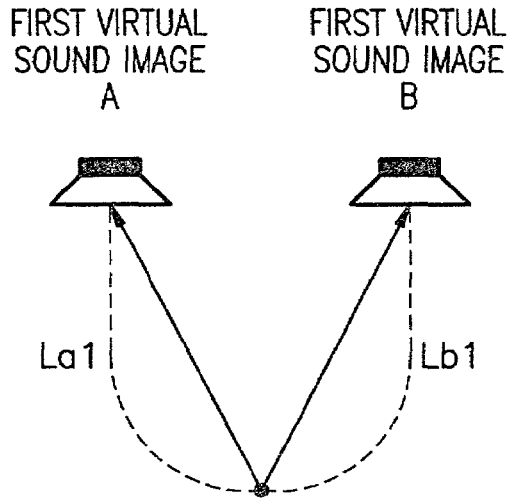
FIGS. 6A and 6B are embodiments each showing the position of the second virtual sound image which is formed due to phase difference.
Figure 6B:
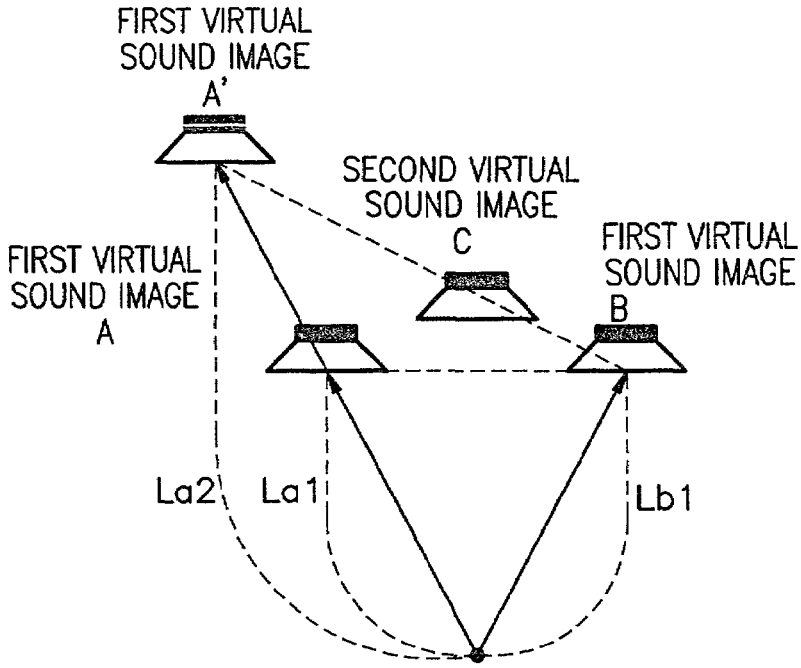

Compensation for a phase difference occurring due to operation is performed as follows. Referring to FIG. 6A, first virtual sound images A and B are separately formed at positions the same distance apart from a reference point. When delay is performed by adjusting the value D which is applied to form the virtual sound image A as a larger value, sound is formed as if it exists at a position of a first virtual sound image A' in FIG. 6B. A final second virtual sound image exists on a straight line connecting the first virtual sound image A' to the first virtual sound image B.

If it is assumed that sound travels at 340 m per second and the number of samples per second (a sampling frequency) is represented by fs, the number of samples existing within l1 is expressed by:

$$340:fs=1:x$$

$$x=fs/340(\text{samples/meter}).$$

In other words, the value D used for forming the virtual sound image A' by carrying out delay is the number of samples corresponding to the distance between the virtual sound image A' and the virtual sound image A. When the distances from the reference point to the respective virtual sound images A and B are the same and the distance between the virtual sound image A' and the virtual sound image A is (La2−La1), the distance (La2−La1) is calculated in terms of meters and a calculated meter value is multiplied by the value x to calculate the number of samples to be delayed. The value D is expressed by:

$$D=(fs/340)*(La2-La1)(\text{samples}).$$

If the virtual sound images A' and A are at the same position, (La2−La1)=0, so that the value D is 0. By adjusting values W and D as described above, the position of the second virtual sound image C formed based on the first virtual sound images A and B can be adjusted.

The embodiment which is applied to a monaural signal has been described. When the embodiment is applied to a stereo or two monaural signals, a virtual sound image for each signal must be formed. This can be accomplished using an overlap characteristic.

Figure 7:
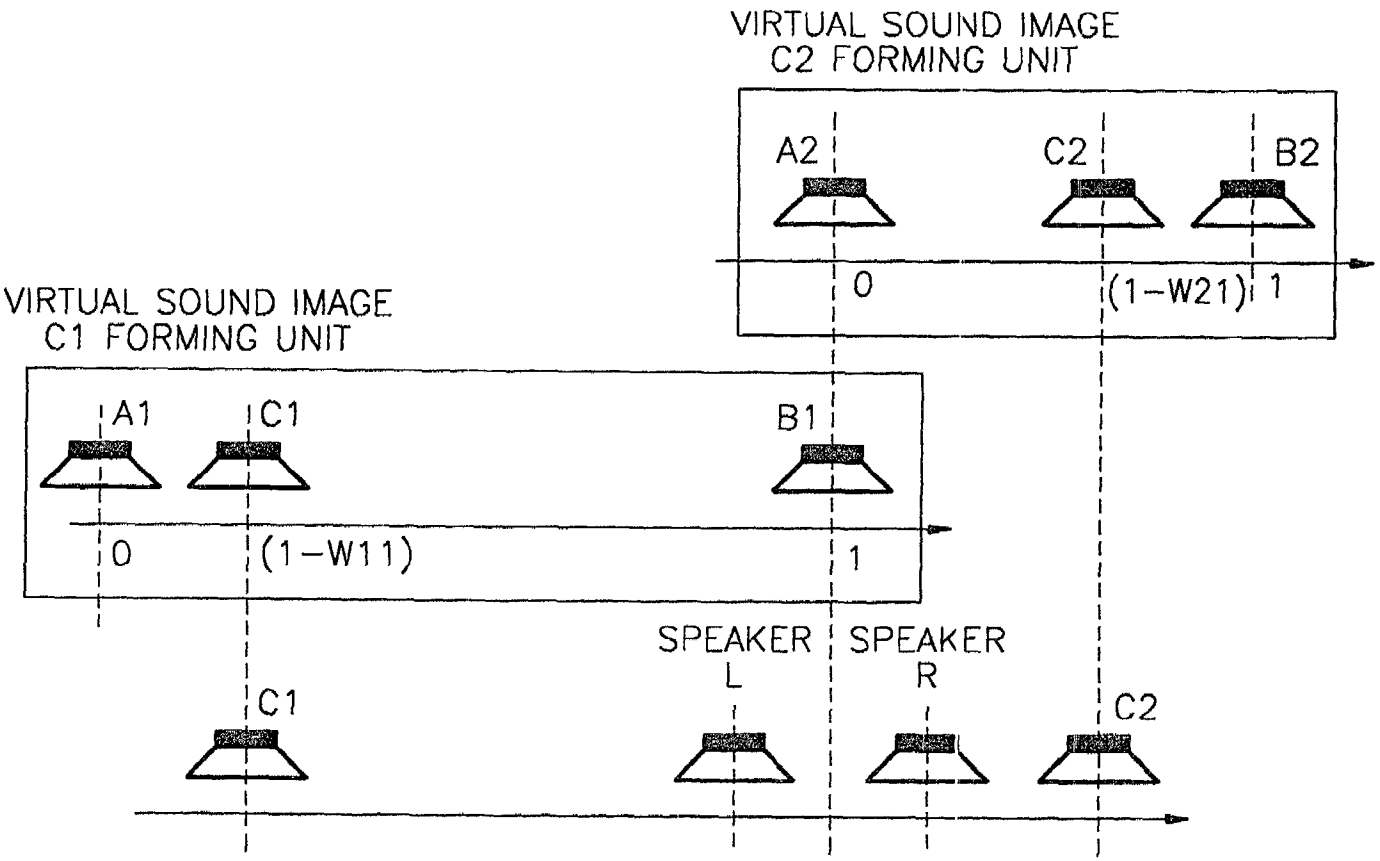
FIG. 7 is an embodiment for forming two virtual sound images, whose positions can be adjusted, with two loudspeakers by adjusting a weighted value.

Referring to FIG. 7, a virtual sound image C1 forming unit and a virtual sound image C2 forming unit are provided to form two virtual sound images. The virtual sound image C1 forming unit forms first virtual sound images A1 and B1 using transfer functions and forms a second virtual sound image C1 using weighted values W11 and W12 applied to the first virtual sound images A1 and B1, respectively. The virtual sound image C2 forming unit forms first virtual sound images A2 and B2 using transfer functions and forms a second virtual sound image C2 using weighted values W21 and W22 applied to the first virtual sound images A2 and B2, respectively. The virtual sound images C1 and C2 formed by the two virtual sound image forming units are added and thus, a listener can notice the two virtual sound images C1 and C2 when sound is reproduced through two loudspeakers.

Figure 8:
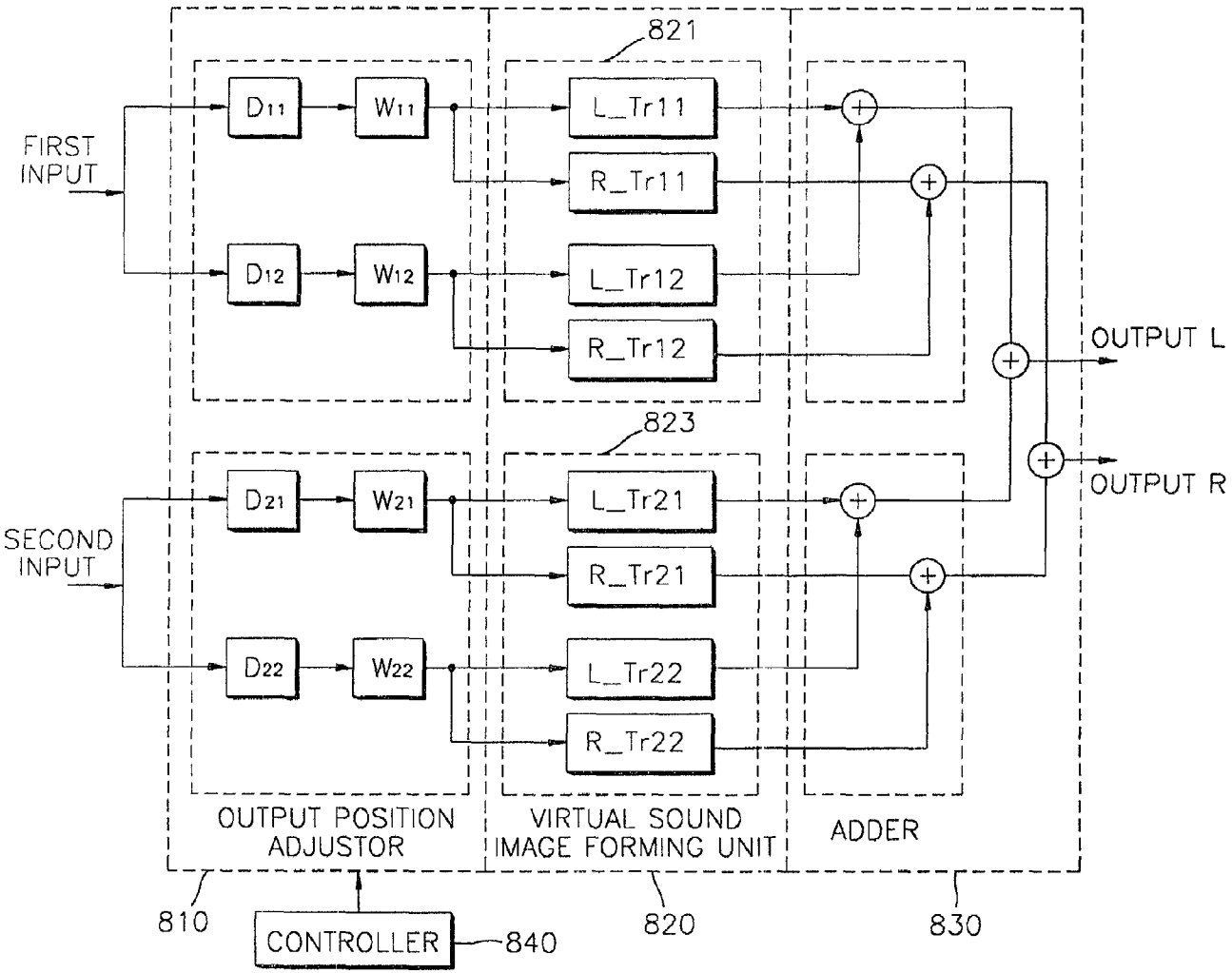
FIG. 8 is a block diagram for showing a method of forming two virtual sound images whose positions can be adjusted by an embodiment of a method for forming virtual sound images, whose positions can be adjusted in a three dimensional space, with a loudspeaker, according to the present invention.

A method for forming two virtual sound images as shown in FIG. 7 is shown in FIG. 8. FIG. 1 shows an apparatus for forming two position adjustable virtual sound images, which is an embodiment of an apparatus for forming virtual sound images whose positions can be adjusted in a three dimensional space through loudspeakers. The apparatus of FIG. 8 is configured as if it includes two virtual sound image forming units. A controller 840 generates and outputs values D and W which are used for forming a second virtual sound image taking into account the position of first virtual sound images. First virtual sound images A1 and B1 for a first input are formed by an output position controller 810 and the virtual sound image forming unit 820. A second virtual sound image C1 is formed based on the first virtual sound images A1 and B1 by the adder 830. First virtual sound images A2 and B2 for a second input are formed by the output position controller 810 and the virtual sound image forming unit 820. A second virtual sound image C2 is formed based on the first virtual sound images A2 and B2 by the adder 830. The second virtual sound images C1 and C2 are finally added. Thus, the two virtual sound images C1 and C2 are formed through two loudspeakers. When positioning one of the first virtual sound images directly in front of a listener, some of the transfer functions used in FIG. 8 can be changed to 1. For example, when positioning the first virtual sound images B1 and A2 at the center between a loudspeaker L and a loudspeaker R, L_Tr12 and R_Tr12 in a virtual sound image forming unit 821 for forming a virtual sound image for the first input are identical to L_Tr21 and R_Tr21 in a virtual sound image forming unit 823 for forming a virtual sound image for the second input, respectively. The simplest case is a case in which all transfer functions are 1. If the transfer functions L_Tr12, R_Tr12, L_Tr21 and R_Tr21 are all 1, FIG. 8 can be modified into FIG. 9.

Figure 9:
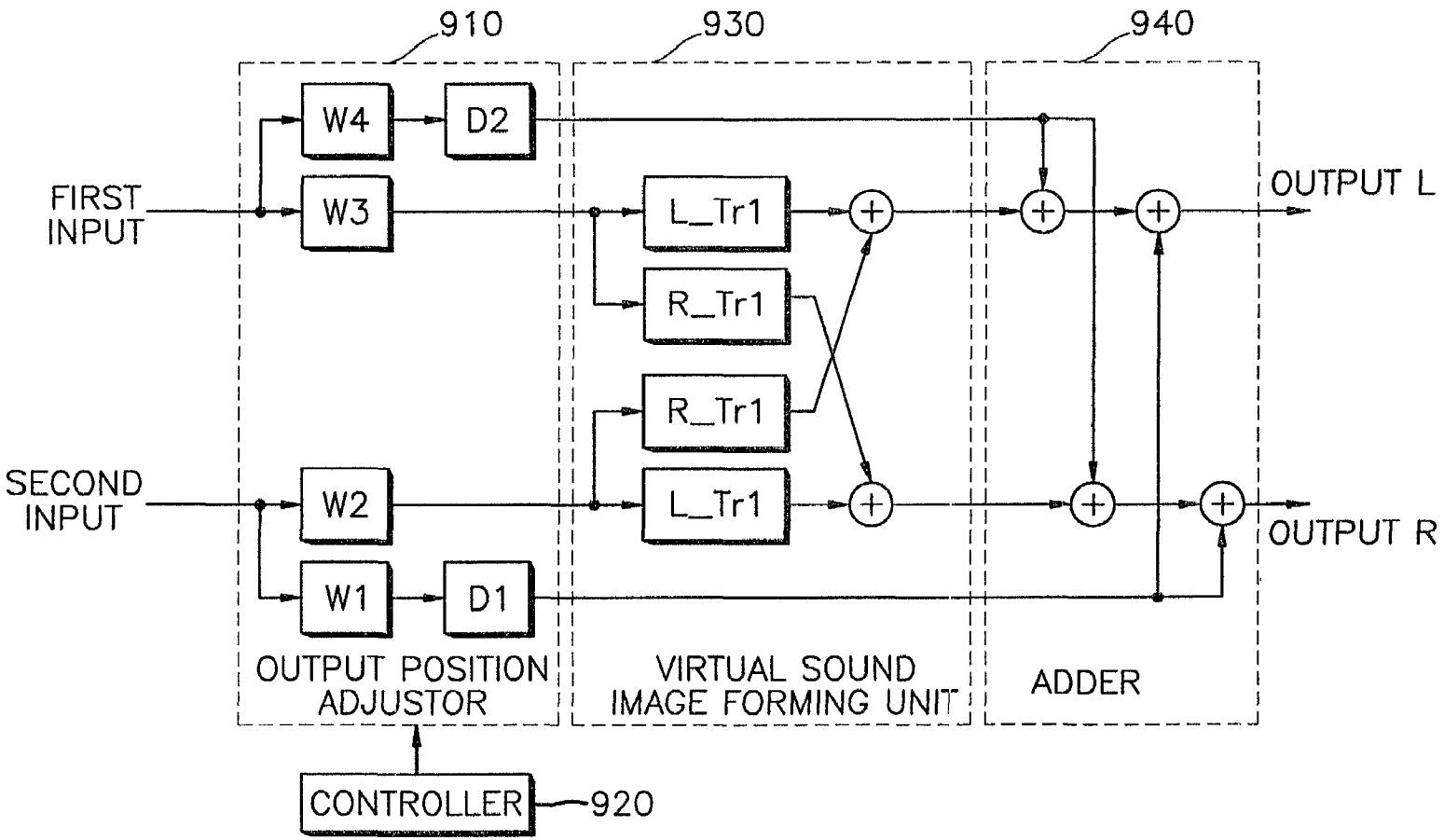
FIG. 9 is a block diagram for showing a method for forming two virtual sound images whose positions can be simply adjusted by positioning one of first virtual sound images at the center of two loudspeakers, by an embodiment of a method of forming virtual sound images, whose positions can be adjusted in a three dimensional space, with a loudspeaker, according to the present invention.

Referring to FIG. 9, once first and second inputs are received, an output position adjustor 910 receives values W and D which are used for determining the positions of virtual sound images from a controller 920 and processes the first and second inputs with the values W and D. A virtual sound image forming unit 930 receives processed results and performs operations to form first virtual sound images. An adder 940 adds the operated results and signals related to the left and the right which are input thereto, respectively, to obtain audio signal output values L and R which are used for forming virtual sound images C1 and C2. The values L_Tr1 and R_Tr1 used in the virtual sound image forming unit 930 are values obtained by inverting transfer functions to compensate for the cross-talk between loudspeakers as shown in FIG. 2.

Figure 10:
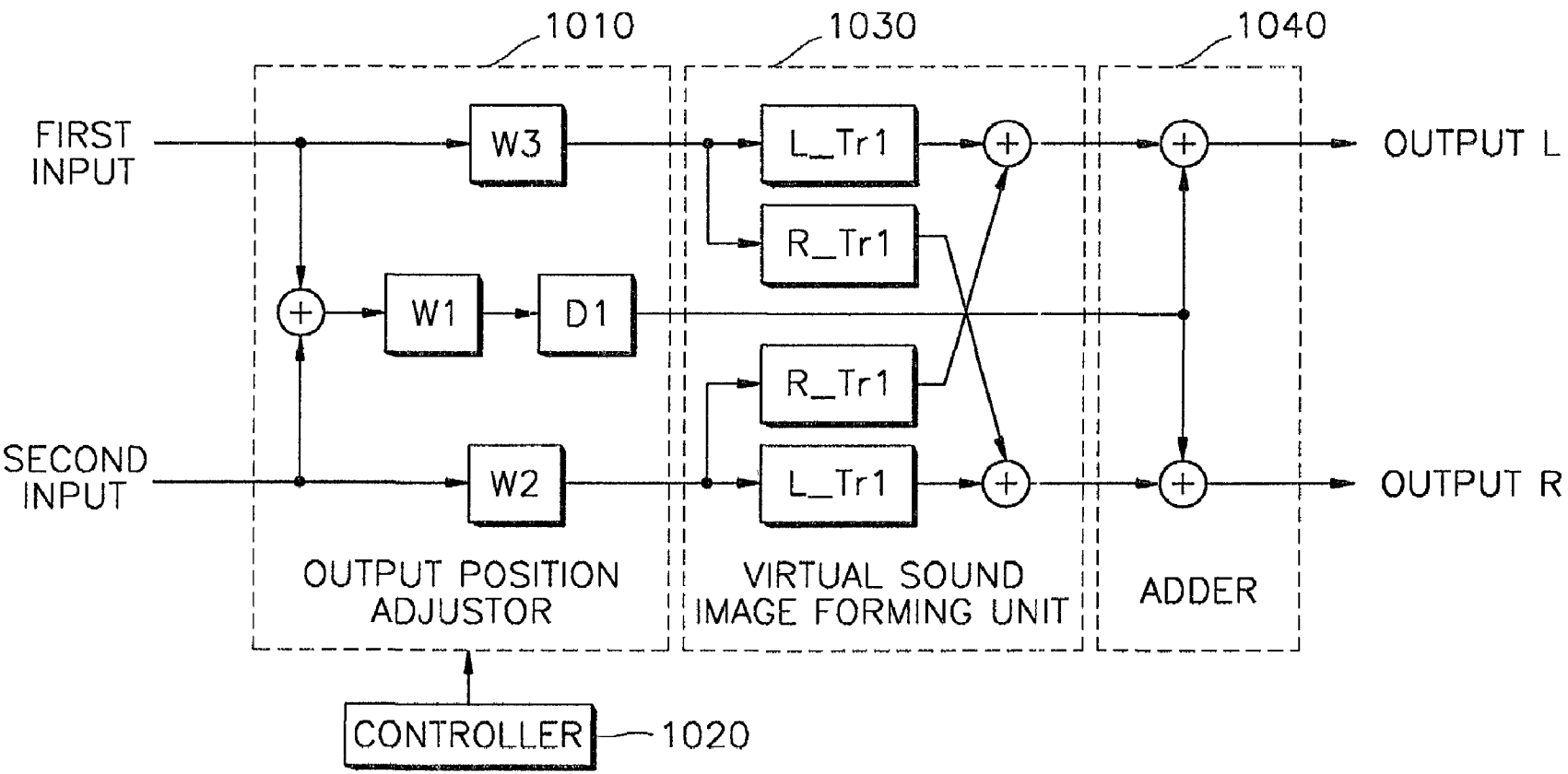
FIG. 10 is a block diagram for showing a method for forming two virtual sound images whose positions can be simply adjusted by symmetrically positioning first virtual sound images at the front left and front right of a listener, by an embodiment of a method of forming virtual sound images, whose positions can be adjusted in a three dimensional space, with a loudspeaker, according to the present invention.

FIG. 10 is a block diagram showing a method of forming two position adjustable virtual sound images by symmetrically forming first virtual sound images in front of a listener, as an embodiment of a method for forming virtual sound images whose position can be adjusted in a three dimensional space through loudspeakers. In FIG. 10, it can be seen that when weighted values for two positional adjustable virtual sound images are the same and the phase delays for the two positional adjustable virtual sound images are the same, that is, when two second virtual sound images are symmetrically formed at the front right and the front left of a listener, W1 and D1 of FIG. 9 become equal to W4 and D2 of FIG. 9, respectively, and symmetrical transfer functions are used, thereby allowing a more simplified implementation.

Figure 11:
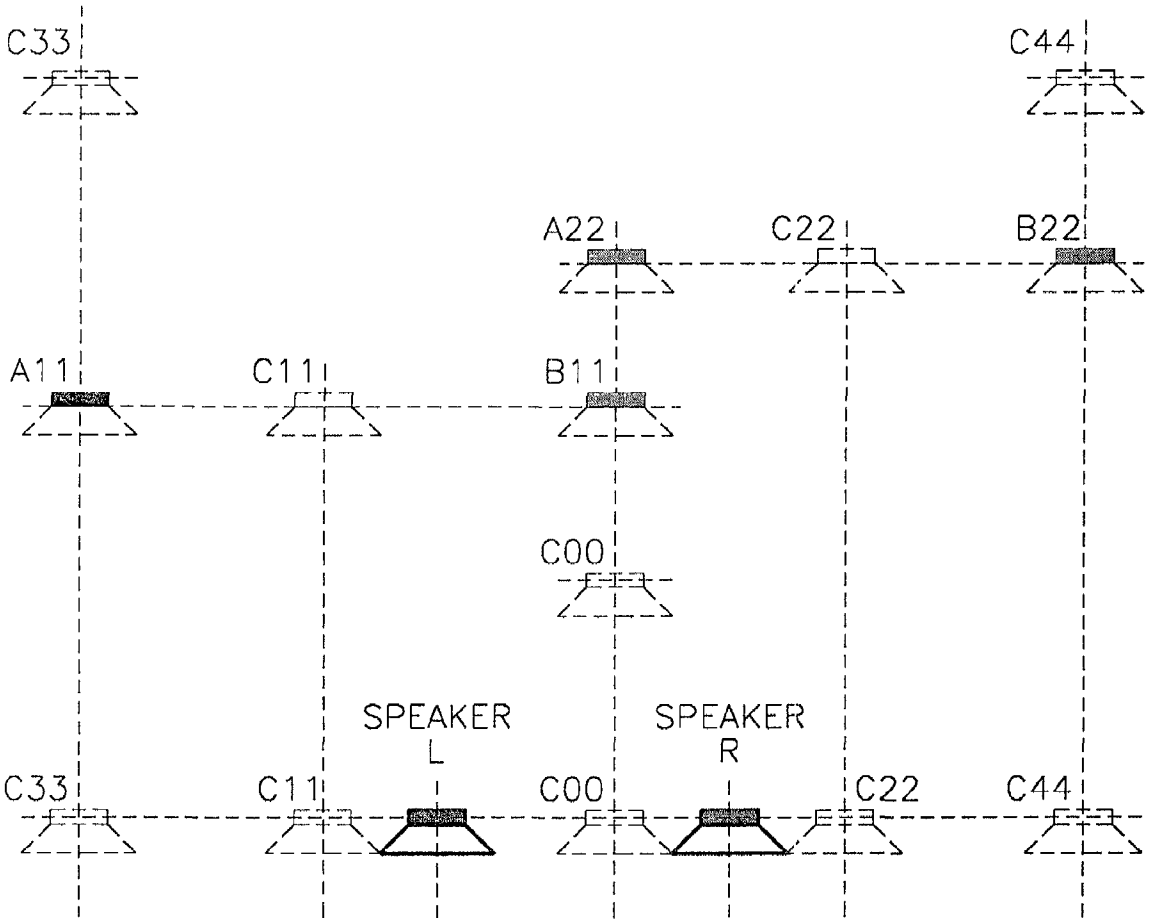
FIG. 11 is a block diagram for showing a method for forming five virtual sound images using two loudspeakers, by an embodiment of a method of forming virtual sound images, whose positions can be adjusted in a three dimensional space, with a loudspeaker, according to the present invention.

FIG. 11 shows a case in which the present invention is applied to reproduce DVD or HDTV multi-channel audio through two loudspeakers. In FIG. 11, a method of forming five virtual sound images using two loudspeakers L and R is shown as an embodiment of a method for forming virtual sound images whose positions can be adjustable in a three dimensional space through loudspeakers.

A virtual sound image COO is positioned at the center between the two loudspeakers L and R. Virtual sound images C33 and C44 are positioned on the left and right sides, respectively. A virtual sound image C11 is positioned between the center between the two loudspeakers and the left side, and a virtual sound image C22 is positioned between the center between the two loudspeakers and the right side. The positions of the virtual sound images are adjusted by controlling weighted values W used for forming the virtual sound images.

Accordingly, five virtual sound images can be formed using only two loudspeakers by means of overlap. Structures as shown in FIGS. 12 and 13 are required to implement FIG. 11.

Figure 12:
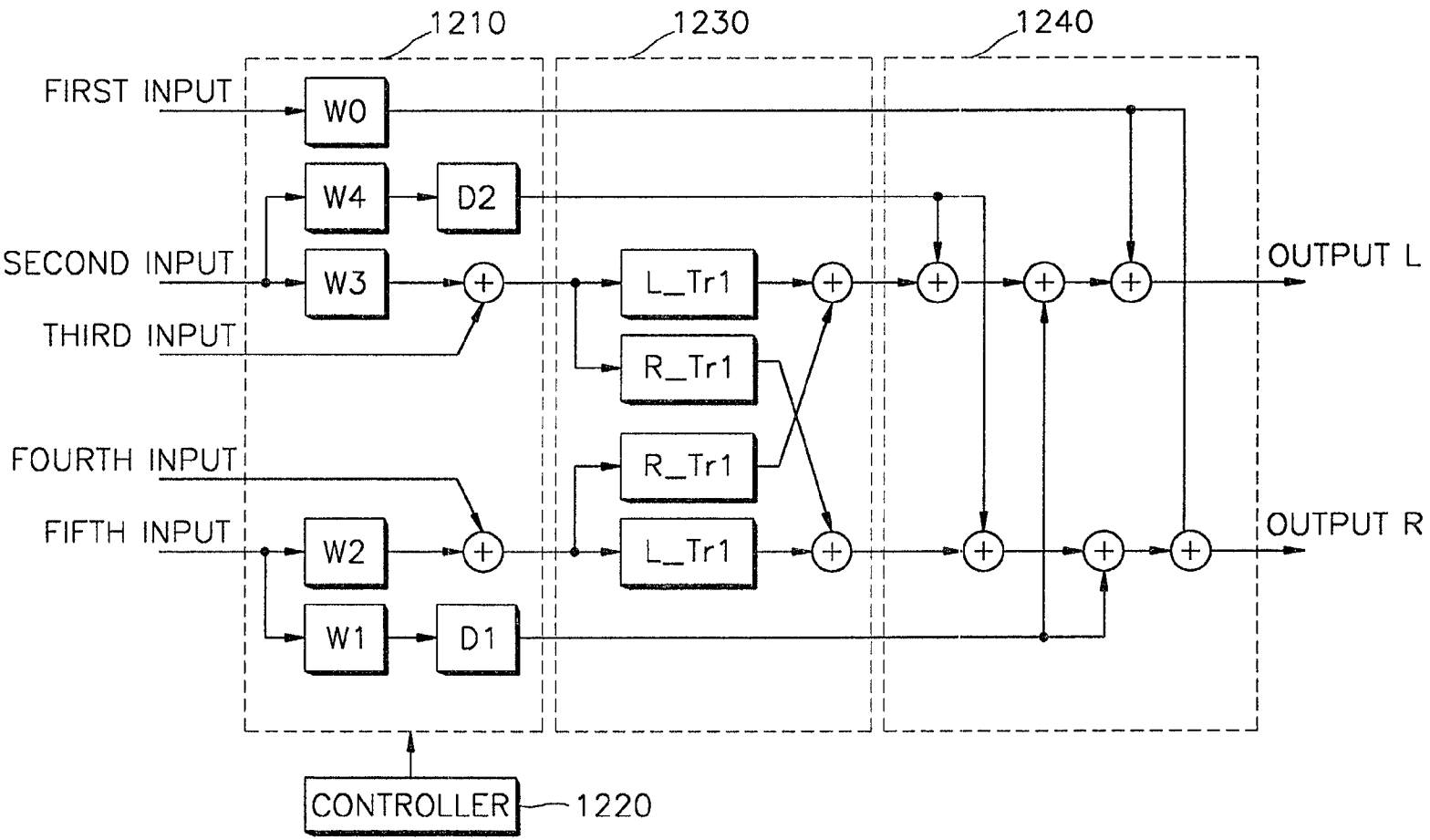
FIG. 12 is a block diagram showing a method of positioning one of first virtual sound images at the center between two loudspeakers, by an embodiment of a method of forming virtual sound images whose positions can be adjustable in a three dimensional space through loudspeakers.

FIG. 12 is a block diagram showing a method of positioning one of first virtual sound images at the center between two loudspeakers, as an embodiment of a method for forming virtual sound images whose positions can be adjustable in a three dimensional space through loudspeakers.

A multi-channel audio signal is composed of a center signal C, a front left signal L, a front right signal R, a back left signal SL and a back right signal SR. An output position adjustor 1210 receives the input signals of five channels and adjusts the input signals of five channels using weighted values and delay information received from a controller 1220. The output position adjustor 1210 transmits the adjusted results to a virtual sound image forming unit 1230. The virtual sound image forming unit 1230 obtains values for positioning virtual sound images using transfer functions for compensating for the cross-talk between loudspeakers as shown in FIG. 2. An adder 1240 performs addition operations with respect to the obtained values from the virtual sound image forming unit 1230 to generate five virtual sound image signals. The five virtual sound image signals are selectively added to output signals L and R. The signals L and R are reproduced through two loudspeakers and thus, a listener can experience the effect of reproduction of five channels even in a case of two channel reproduction.

Figure 13:
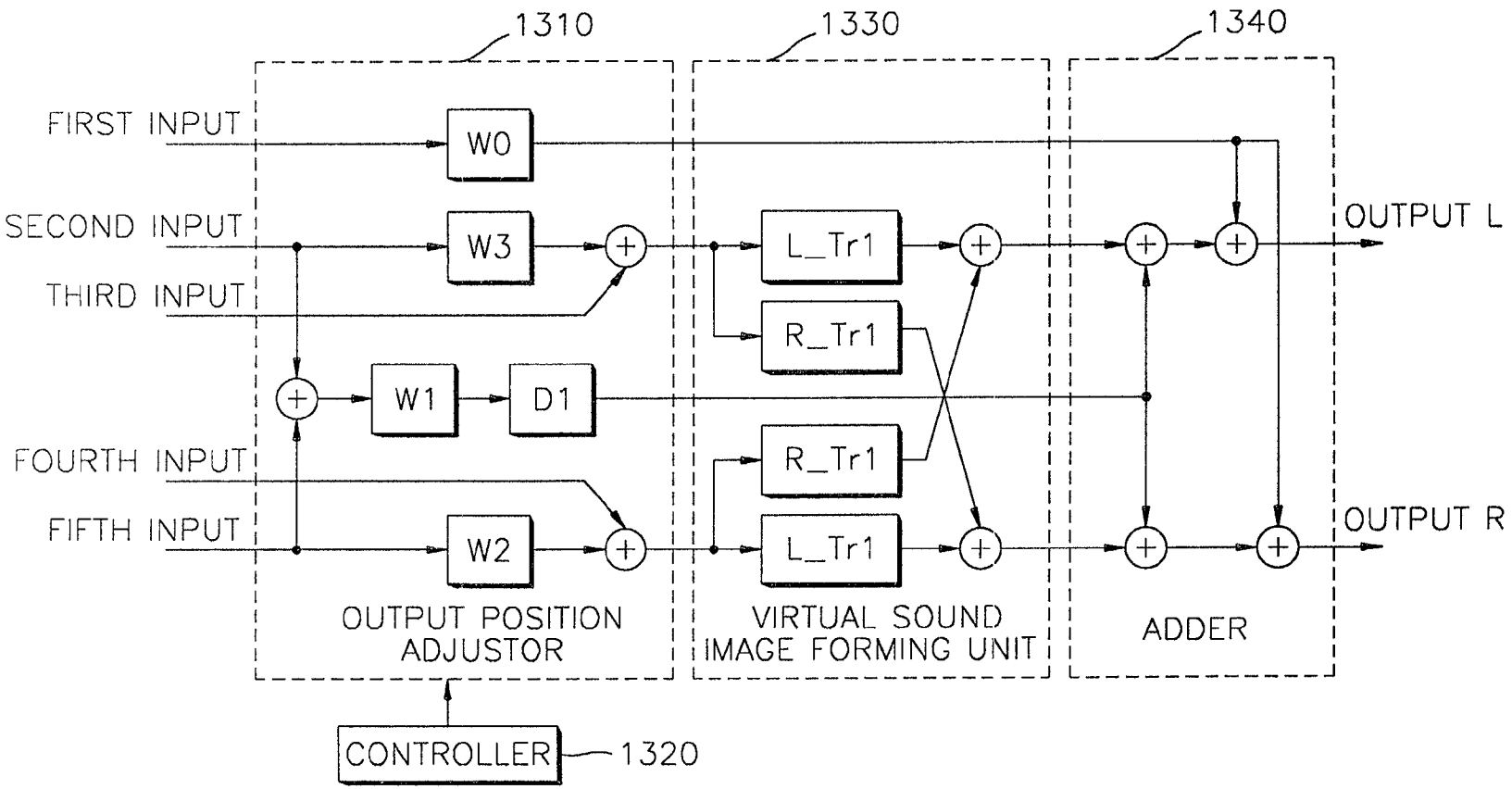
FIG. 13 is a block diagram showing a method of symmetrically positioning first virtual sound images at the front left and front right of a listener, as an embodiment of a method for forming virtual sound images whose positions can be adjustable in a three dimensional space through loudspeakers.

FIG. 13 is a block diagram showing a method of symmetrically positioning first virtual sound images at the front left and front right of a listener, as an embodiment of a method for forming virtual sound images whose positions can be adjustable in a three dimensional space through loudspeakers.

When processing multi-channel audio with emphasis on the front signals, an output position adjustor 1310 obtains components for front signals and left and right sound image components. A virtual sound image forming unit 1330 processes the obtained components received from the output position adjustor 1310 so as to form virtual sound images at positions in a three dimensional space. An adder 1340 adds the processed virtual sound images.

According to the present invention as described above, first, the positions of virtual sound images can be adjusted. Second, a virtual sound image can be formed at different positions with only one set of transfer functions. Third, the present invention can be implemented without a complex operational unit. Fourth, multi-channel audio effect can be accomplished with a small number of loudspeakers. Finally, complexity increases by only a small amount when the number of virtual sound images increases.

The present invention has been described by way of exemplary embodiments to which it is not limited. Variations and modifications will occur to those skilled in the art without departing from the scope of the invention as set out in the following claims.

What is claimed is:

1. A multi-channel audio reproduction apparatus for loudspeaker reproduction using a virtual sound image whose positions can be adjusted with respect to an input monaural audio signal, the multi-channel audio reproduction apparatus comprising:

a controller for generating weighted values and values of phase delay for adjusting a position at which a second virtual sound image will be formed based on a predetermined position A at which a first virtual sound image A will be formed and a predetermined position B at which another first virtual sound image B will be formed with respect to the input monaural audio signal for loudspeaker reproduction, wherein the value of the phase delay for the virtual sound image position A comprises a measure of a distance between a virtual sound image position A and a virtual sound image position A' for forming the first virtual sound image A and the value of phase delay for the virtual sound image position B comprises a measure of distance between the virtual sound image position B and virtual sound image position B' for forming the first virtual sound image B;

an output position adjustor for dividing the input monaural audio signal into two signals and applying the weighted values and the values of phase delay to corresponding signals of the divided monaural audio signal to adjust the position at which the second virtual sound image will be formed to a desired position between positions A and B;

a virtual sound image forming unit for loudspeakers comprising an A transfer function processor for multiplying the monaural audio signal, obtained by the application of the weighted value and the value of phase delay for the position A to one of the divided monaural audio signals, by transfer functions corresponding to the left and the right ear of a listener for forming the first virtual sound image at the predetermined position A, and a B transfer function processor for multiplying the monaural audio signal, obtained by the application of the weighted value and the value of phase delay for the position B to the other divided monaural audio signal, by transfer functions corresponding to the left and the right ear of the listener for forming the first virtual sound image at the predetermined position B; and an adder for summing up the audio signals obtained by the multiplications of the transfer functions for forming the first virtual sound images at the positions A and B corresponding to the right ear of the listener and summing up the audio signals obtained by the multiplications of the transfer functions for forming the first virtual sound images at the positions A and B corresponding to the left ear of the listener to generate left and right signals for loudspeakers for forming the second virtual sound image at the desired position between positions A and B.

2. A multi-channel audio reproduction method for loudspeaker reproduction using virtual sound images whose positions can be adjusted with respect to an input monaural audio signal, the multi-channel audio reproduction method comprising the steps of:

(a) generating signals for forming a first virtual sound A image at a predetermined position A in a three dimensional space and signals for forming another first virtual sound image B at a predetermined position B in the three dimensional space, with respect to the input audio signal for loudspeaker reproduction;

(b) applying weighted values and values of phase delay to the signals for forming the first virtual sound images at the positions A and B, respectively, to adjust spatial positions of the first virtual sound images and the phase differences between the signals for forming the first virtual sound images based on a desired position between the positions A and B for forming a second virtual sound image through loudspeakers, wherein the value of phase delay for the position A comprises a measure of a distance between the position A and a position A' for forming the first virtual sound image A and the value of phase delay for the position B comprises a measure of a distance between the position B and a position B' for forming the first virtual sound image B; and (c) summing up the weighted and phase delayed adjusted signals for the positions A and B corresponding to the right ear of a listener and summing up the weighted and phase delayed adjusted signals for the positions A and B corresponding to the left ear of the listener to generate left and right signals for loudspeakers for forming the second virtual sound image at the desired position between positions A and B.

3. A multi-channel audio reproduction method for loudspeaker reproduction using virtual sound images whose positions can be adjusted with respect to an input monaural audio signal, the multi-channel audio reproduction method comprising the steps of:

(a) applying first and second weighted values and values of phase delay corresponding to predetermined positions A and B at which first virtual sound images A and B will be formed, respectively, to the input monaural audio signal to adjust a desired position between the positions A and B at which a second virtual sound image will be formed through loudspeakers, phase delay for the position A comprises a measure of a distance between the position A and a position A' for forming the first virtual sound image A and the value of phase delay for the position B comprises a measure of a distance between the position B and a position B' for forming the first virtual sound image B;

(b) multiplying an audio signal obtained by the application of the first weighted value and the value of phase delay for the position A to the input monaural audio signal by transfer functions for forming the first virtual sound image at the predetermined position A, and multiplying an audio signal obtained by the application of the second weighted value and the value of phase delay for the position B to the input monaural audio signal by transfer functions for forming the first virtual sound image at the predetermined position B for loudspeaker reproduction; and (c) summing up signals obtained by the multiplications of the transfer functions for forming the first virtual sound images at the positions A and B corresponding to the right ear of a listener and summing up signals obtained by the multiplications of the transfer functions for forming the first virtual sound images at the positions A and B corresponding to the left ear of the listener to generate left and right signals for loudspeakers for forming the second virtual sound image at the desired position between positions A and B.

* * * * *